United States Patent [19]

Bennett

[11] 4,098,417

[45] Jul. 4, 1978

[54] CHILD PROOF PLUG FITMENT

[76] Inventor: Robert A. Bennett, 170 Sturbridge Rd., Easton, Conn. 06424

[21] Appl. No.: 850,616

[22] Filed: Nov. 11, 1977

[51] Int. Cl.[2] ..... B65D 55/02; B65D 85/56

[52] U.S. Cl. ..... 215/204; 215/207; 215/211; 215/215; 215/302; 215/296

[58] Field of Search ..... 215/204, 207, 211, 215, 215/302, 296

[56] References Cited

U.S. PATENT DOCUMENTS

| | | | |
|---|---|---|---|
| 3,473,681 | 10/1969 | Hall, Jr. | 215/204 |
| 3,811,590 | 5/1974 | Hall, Jr. | 215/207 |
| 3,831,796 | 8/1974 | Claasen | 215/204 X |

*Primary Examiner*—George T. Hall

[57] ABSTRACT

A plug fitment adapted to be removably inserted in a circular port to seal same in a substantially air tight manner comprises a somewhat flexible body of generally cylindrical shape. The body has an open upper end and an interior region bounded by an inner wall and communicating with the open end and has a vertical axis. The upper end has a circular peripheral lip lying in a horizontal plane and having an inner periphery defining the periphery of a circular opening centered on said axis. Slightly flexible means disposed in said upper end and said region includes a vertical member spaced from the inner wall and aligned with said axis. The member has a top end disposed below said horizontal plane. The member has a vertical slit extending downwardly from the top end to a bottom position intermediate the top end and the bottom of said member. A circular generally flat slightly flexible key disc is disposed horizontally and removably in said opening. The disc has a lower surface resting upon said top end of the member and an upper surface essentially coplanar with said lip. The disc, when removed from said opening and oriented vertically, is removably insertable in said slit. The thickness of the disc and the width of the slit have relative values at which the disc, when inserted in the slit, cannot be separated from the body until the body and disc are removed as a unit from said port, whereby after the unit is so removed, the body and disc can be pulled apart manually.

6 Claims, 8 Drawing Figures

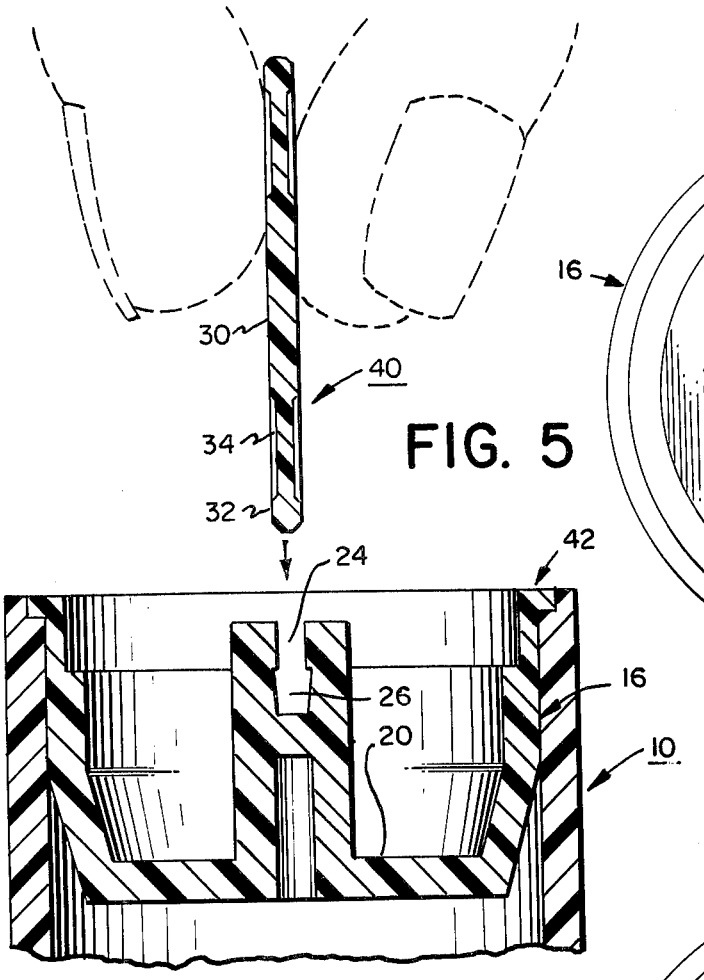
FIG. 5
FIG. 8
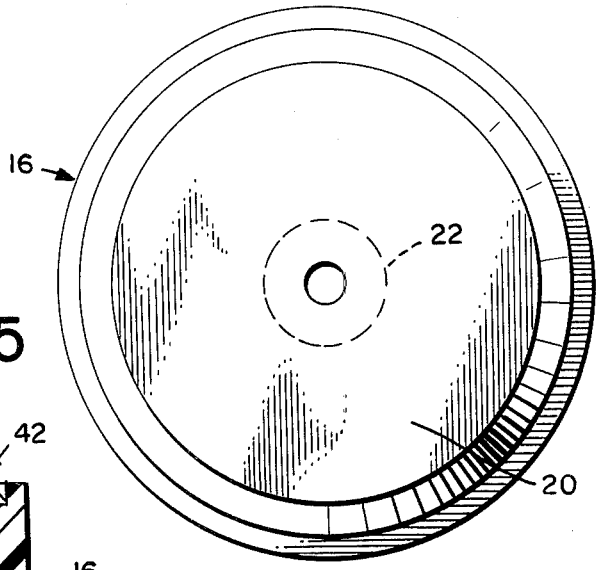
FIG. 6
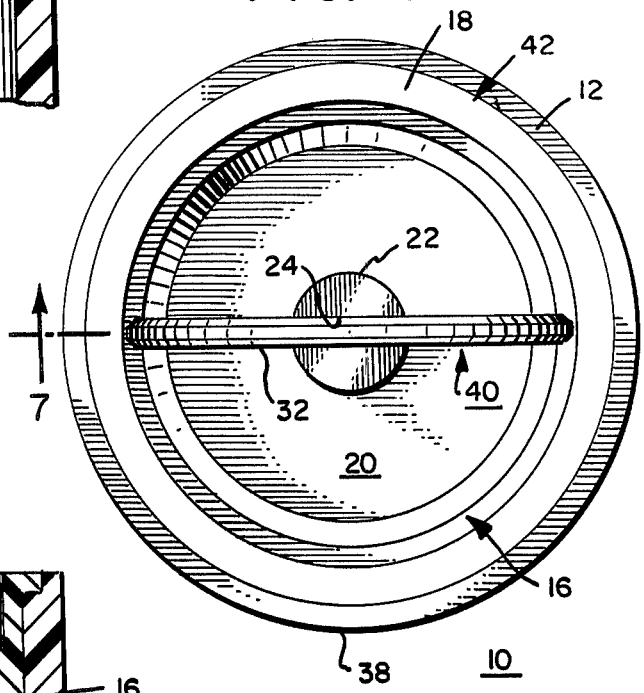
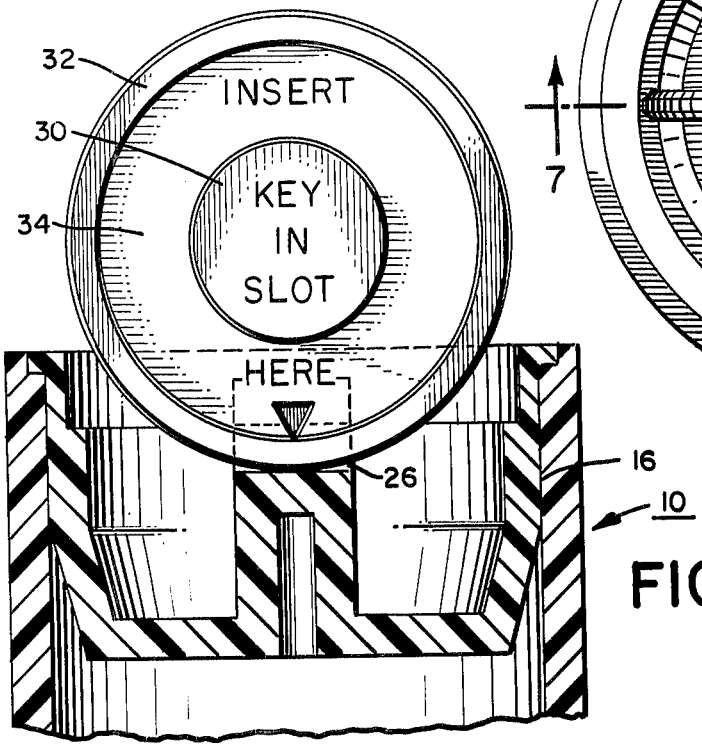
FIG. 7

CHILD PROOF PLUG FITMENT

PRIOR ART STATEMENT

The only plug fitment known to applicant which is supposed to be child proof takes the form of a vertical hollow cylinder having a closed bottom end with a lower lip tapering downward and inward below the closed end. The top end of the cylinder is open. A flexible flat disc is disposed in the top opening and is secured to a portion of the inner periphery of the top open end by an integral living hinge. The peripheral edge of the disc otherwise bears removably against this inner periphery.

The cylinder is inserted removably into the neck of a medicine containing vial or the like to form an air tight seal. In order to remove the cylinder, the user must first press downward upon the center of the disc whereby a portion of the peripheral edge of the disc is flexed upwardly above the top end of the cylinder. The user then grasps the disc and swings it upward about the hinge. Then the user pulls the disc upward in one hand while holding the vial in the other hand, pulling the cylinder and disc as a unit out of the vial.

BACKGROUND OF THE INVENTION

Child proof caps for medicine vials and the like are well known. Such caps however do not provide an air tight seal which is often required to prevent spoilage of the contents of such vials. Plug fitments are used as air tight seals. Characteristically such fitments are plastic hollow somewhat flexible cylinders with an end that tapers inward, the tapered end being inserted removably into the neck or other suitable opening.

There is a clear need for child proof plug fitments which cannot be removed from the vial by a child. The only plug fitment known to applicant which is supposedly child proof has been described above in the prior art statement. This known fitment however has been found to be unsatisfactory in that some children have learned by trial and error how to remove the fitment whereby it is not completely child proof.

The present invention overcomes this difficulty and provides a plug fitment which is not only child proof but which cannot be removed from a vial without damage by an adult who does not know how to remove the fitment.

SUMMARY OF THE INVENTION

In accordance with the principles of this invention, a child proof plug fitment adapted to be removably inserted in a circular port to seal same in a substantially air tight manner, employs a somewhat flexible body of generally cylindrical shape which has a vertical axis. This body has an open upper end and an interior region bounded by an inner wall and communicating with the open end. The upper end has a circular peripheral lip lying in a horizontal plane with an inner periphery defining the periphery of a circular opening centered on said axis.

Slightly flexible means disposed in said upper end and said region includes a vertical member spaced from the inner wall and aligned with said axis said member having a top end disposed below said horizontal plane, with a vertical slit extending downwardly from the top end to a bottom position intermediate the top end and the bottom of said member.

A circular generally flat slightly flexible key disc is disposed horizontally and removably in said opening. This disc has a lower surface resting upon said top end of the member and an upper surface essentially coplanar with said lip.

When the disc is removed from said opening and oriented vertically, it can be removably inserted in said slit. The thickness of the disc and the width of the slit have relative values at which the disc when inserted in the slit cannot be separated from the body until the body and disc are removed as a unit from said port, whereby after the unit is so removed, the body and disc can be pulled apart manually.

In use the disc is disposed in the opening. There is sufficient clearance between the peripheral edge of the disc and the inner periphery of the lip to enable the user, but applying downward pressure at any point along the disc periphery, to cause the disc to tilt from the horizontal whereby the tilted disc can be removed manually from the upper end of the body for use as described above.

Children and adults, when confronted with the fitment, tend to press upon the center of the disc to remove it. However, since this center bears against the top end of the vertical member, such pressure is uneffective. If by some chance, the pressure is applied peripherally to enable removal of the disc, the child or adult attempts to grasp the top end of the member to pull the cylinder out of the port, but such attempts cannot succeed. The proper use of the disc as a type of key inserted into the slot has not as yet been recognized by any child or adult who has not been previously instructed in proper operation of the fitment.

The dimensions of the plug fitment are so chosen that a penny can be used in place of the disc if the disc is lost or otherwise not available.

BRIEF DESCRIPTION OF THE DRAWINGS

FIG. 5 is a view similar to FIG. 3 but illustrating the keying action of the disc.

FIG. 6 is a top view of the structure shown in FIG. 7.

FIG. 7 is a view taken along line 6—6 in FIG. 6.

FIG. 8 is a bottom view of the invention.

DETAILED DESCRIPTION OF PREFERRED EMBODIMENT

Figure 1:
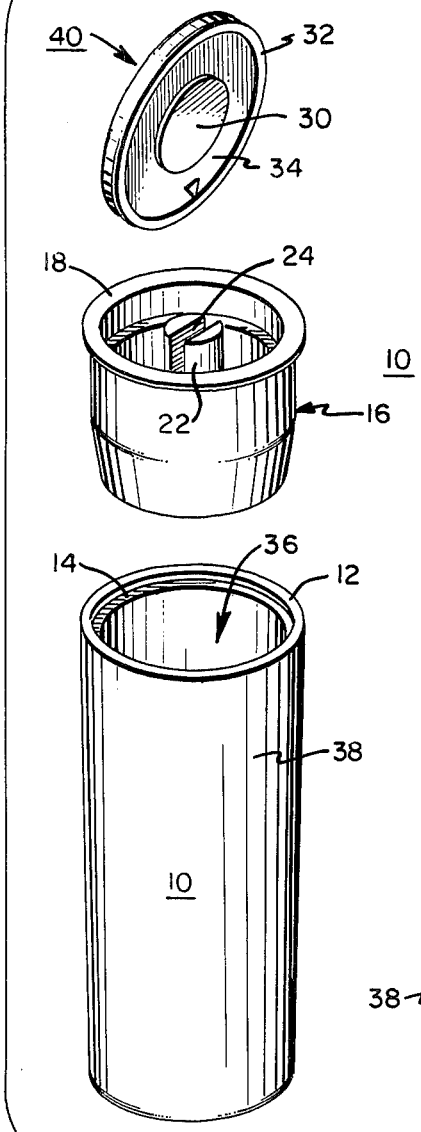
FIG. 1 is an exploded view of the invention.
Figure 2:
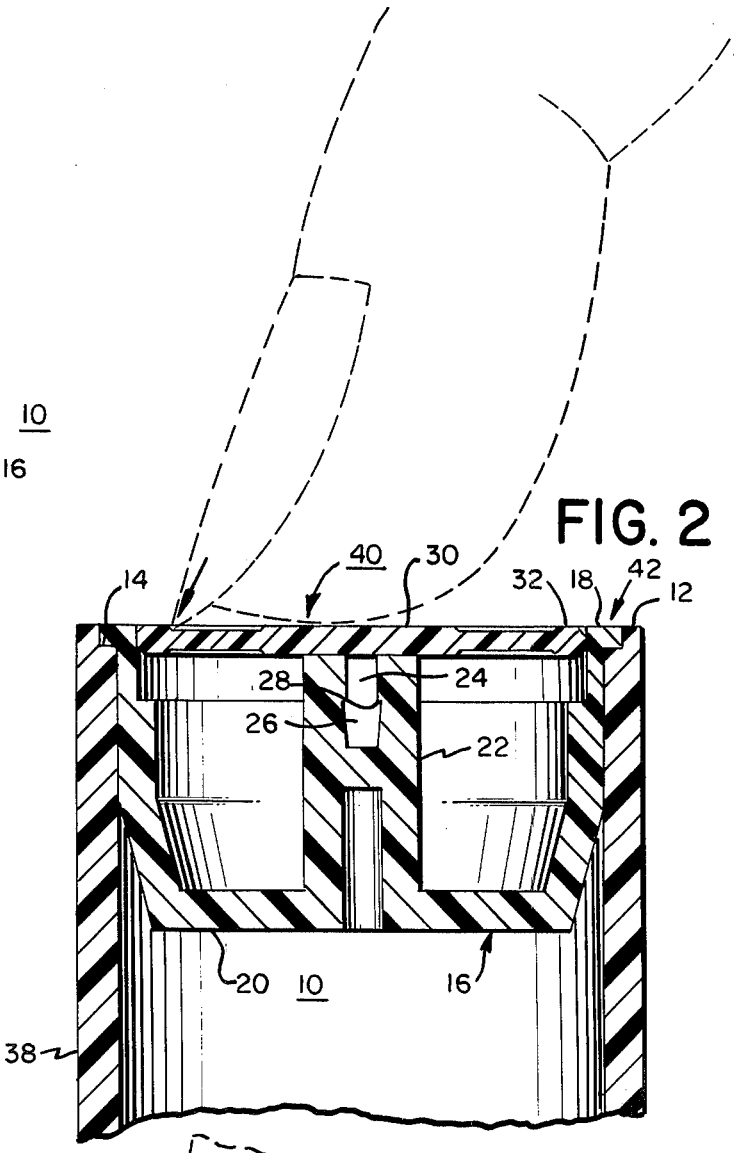
FIG. 2 is an enlarged fragmentary vertical cross section of the invention ready for use.
Figure 3:
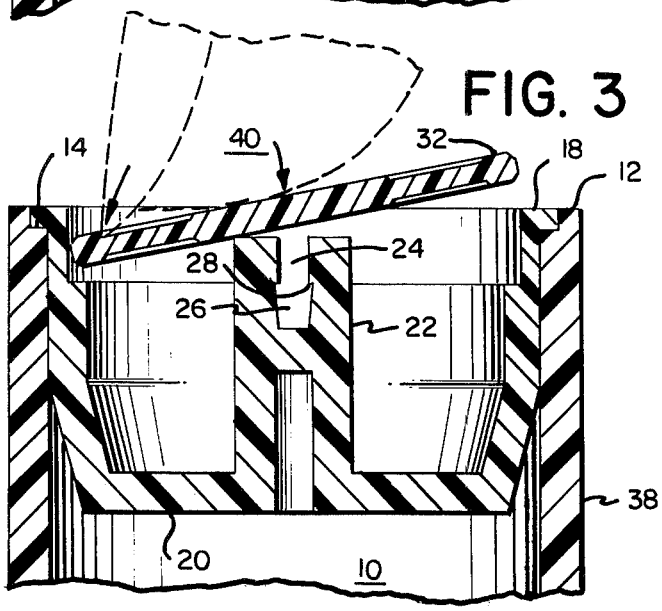
FIG. 3 is a view similar to FIG. 2 but illustrating the disc tilting action.
Figure 4:
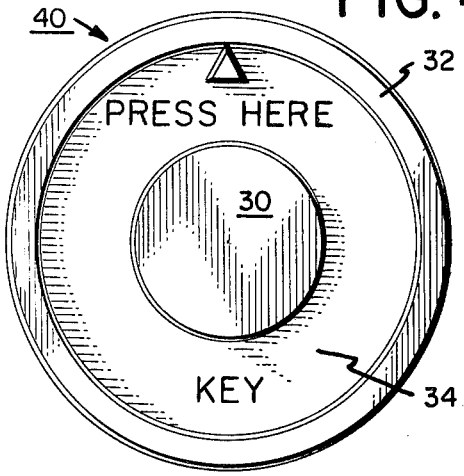
FIG. 4 is a top view of the structure shown in FIG. 2.

Referring now to FIGS. 1–8, the invention consists of various parts which are all slightly flexible, being formed for example of a plastic such as medium polypropelene.

Body 10 takes the form of a vertical hollow cylinder with a vertical axis. The bottom portion of the cylinder tapers downward and inward to a flat horizontal closed lower end. The upper end of the body is open with a flat horizontal circular outer edge 12. The inner portion of the edge 12 is cut away to form a recessed shoulder 14.

A second hollow body 16 takes the form of a vertical hollow cylinder with an open top end having an outer flat horizontal circular ridge 18 which snap fits into shoulder 14 when body 16 is inserted into body 10. The outer wall of the upper portion of body 16 engages the inner surface of body 10 and the axis of body 16 is coincident with the axis of body 10. The lower portion of body 16 has an outer wall which tapers downward and inward to a horizontal bottom closed end 20 disposed intermediate upper and lower ends of body 10.

Body 16 has an axially aligned integral vertical member 22 spaced from the inner walls of body 16 with a bottom end integral with end 20. Edge 12 and ridge 18 form jointly a circular peripheral lip lying in a horizontal plane. The top end of member 22 is flat and horizontal and is spaced below the horizontal plane of the lip by a selected depth as for example 0.060 inches. A vertical slit extends downward from the top end of member 22 to a point intermediate the top and bottom ends thereof.

This slit has an upper portion 24 of uniform width equal to slightly less than said depth as for example 0.040. The slit has a lower portion 26 which is slightly undercut at the region common to both upper and lower portions (indicated as shoulder 28) at each side by a small amount as for example 0.010 inches whereby the slit thickness in this region is approximately equal to the selected depth as for example 0.064. The width of this lower portion then tapers downward and inward to a bottom width substantially equal to the uniform width.

A circular generally flat key disc 40 has a diameter only slightly less than the inner diameter of the lip and is disposed in the circular opening in the upper end of the joined bodies 10 and 16 which is defined by the inner lip periphery and which is centered on the common vertical axis of the two bodies. The disc has a circular central section 30 with horizontal upper and lower surfaces. This section has a thickness equal to said selected depth of 0.060 inches whereby the lower surface rests upon the top end of member 22 and the upper surface is coincident with the plane of the lip. The disc has a peripheral circular section 32 having like thickness. The disc has a recessed area 34 of lesser thickness disposed between sections 30 and 32, this lesser thickness being essentially equal to the uniform thickness of portion 24 of the slit.

Because of the slight but sufficient clearance between the peripheral edge of the disc and the inner periphery of the lip, application of downward pressure at any point along the disc periphery will cause it to be tilted slightly from the horizontal whereby it can be pulled out.

When the disc is disposed vertically, it can be pushed into the slit until the recessed area 34 is disposed in portion 24 and section 32 is disposed in portion 26. This action is made possible by the slight yielding or flexing of the various parts.

Once the disc is so disposed in the slit, it is locked into the member 22 whereby the device can only be removed as a unit out of air tight engagement in port 36 of hollow tube or vial 38.

However once the device is removed as a unit, the aforesaid yielding or flexing enables the user, by holding body 10 in one hand and disc 40 in the other, to pull the disc out of the member whereby the device can be reassembled for subsequent reuse.

What is claimed is:

1. A plug fitment adapted to be removably inserted in a circular port to seal same in a substantially air tight manner, said fitment comprising:

a somewhat flexible body of generally cylindrical shape with a vertical axis, said body having an open upper end and an interior region bounded by an inner wall and communicating with the open end, said upper end having a circular peripheral lip lying in a horizontal plane with an inner periphery defining the periphery of a circular opening centered on said axis;

slightly flexible means disposed in said upper end and said region and including a vertical member spaced from the inner wall and aligned with said axis, said member having a top end disposed below said horizontal plane, said member having a vertical slit extending downwardly from the top end to a bottom position intermediate the top end and the bottom of said member; and a circular generally flat slightly flexible key disc disposed horizontally and removably in said opening, said disc having a lower surface resting upon said top end of the member and an upper surface essentially coplanar with said lip, said disc, when removed from said opening and oriented vertically, being removably insertable in said slit, the thickness of the disc and the width of the slit having relative values at which the disc, when inserted in the slit, cannot be separated from the body until the body and disc are removed as a unit from said port, whereby after the unit is so removed, the body and disc can be pulled apart manually.

2. The fitment of claim 1 wherein said means and said body cooperate and jointly define said lip and opening.

3. The fitment of claim 2 wherein clearance between the peripheral edge of the disc and the inner periphery of the lip enables a user, by applying downward pressure at any point along the disc periphery when the disc is disposed in the central opening, to cause the disc to tilt from the horizontal, whereby the tilted disc can be removed manually from the upper end of the body.

4. The fitment of claim 3 wherein said slit has an upper section of uniform thickness and a lower section having a thickness which in the region common to both sections is slightly larger than said uniform thickness, said lower section having a slight downward and inward taper whereby the thickness of the lower section at the bottom position is equal to said uniform thickness, and wherein said disc has a peripheral circular section and a spaced central circular section having like thicknesses equal to said slightly larger thickness, the upper and lower disc surfaces in the space between said two sections being slightly recessed, the thickness of the disc in the recessed area being equal to said uniform thickness.

5. The fitment of claim 4 wherein said body is a hollow vertical cylinder which tapers downward and inward at its lower end, said means being fitted into the upper end of the body and extending downward therein to a position intermediate the upper and lower end of the cylinder.

6. The fitment of claim 5 wherein the lower end of the cylinder is closed.

* * * * *